US006250953B1

(12) United States Patent
Niitsu

(10) Patent No.: US 6,250,953 B1
(45) Date of Patent: Jun. 26, 2001

(54) CONNECTOR ASSEMBLY FOR COAXIAL CABLES

(75) Inventor: Toshihiro Niitsu, Machida (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/503,408

(22) Filed: Feb. 14, 2000

(30) Foreign Application Priority Data

Mar. 10, 1999 (JP) ..... 11-063157

(51) Int. Cl.[7] ..... H01R 13/424
(52) U.S. Cl. ..... 439/497; 439/578
(58) Field of Search ..... 439/579, 581, 439/326, 327, 328, 329, 497, 499

(56) References Cited

U.S. PATENT DOCUMENTS 3,188,601 6/1965 DeTar ..... 439/328
4,209,219 * 6/1980 Proietto ..... 439/497
4,640,562 2/1987 Shoemaker ..... 439/327 X
4,735,582 * 4/1988 Fusselman et al. ..... 439/329
5,632,640 * 5/1997 Noda ..... 439/326
5,716,229 * 2/1998 Loder et al. ..... 439/497 X

* cited by examiner

*Primary Examiner*—Renee Luebke
(74) *Attorney, Agent, or Firm*—Stephen Z. Weiss

(57) ABSTRACT

A connector assembly is provided for connecting the conductors of a plurality of coaxial cables to associated electrical circuitry. The assembly includes a fixed connector having a plurality of terminals connected to the electrical circuitry and including contact arms in a side-by-side array at regularly spaced intervals. A movable connector is removably attached to the fixed connector and includes first and second assemblies. The first assembly has a plurality of rigid support members for sandwiching the conductors between the support members and a plurality of terminals of the second assembly. The rigid support members of the first assembly and terminals of the second assembly are in side-by-side arrays at regularly spaced intervals corresponding to the spacing of the contact arms of the fixed connector.

22 Claims, 8 Drawing Sheets

CONNECTOR ASSEMBLY FOR COAXIAL CABLES

FIELD OF THE INVENTION

This invention generally relates to electrical connectors and, particularly, to a connector assembly for connecting a plurality of coaxial cables to electrical circuitry.

BACKGROUND OF THE INVENTION

A typical coaxial cable includes a center conductor or core surrounded by a dielectric which, in turn, is surrounded by a shield such as a tubular foil or metal braid. An outer covering or sheath typically is provided about the cable. A plurality of the cables may be terminated by a connector as discrete or individual cables, or the cables may be incorporated in a generally planar or flat composite often called a "ribbon" cable. In any event, the connector must terminate and/or interconnect a plurality of discrete conductors.

With the ever-increasing miniaturization and high density of electronic circuitry, terminating coaxial cables has become quite difficult. For instance, the core conductor of a coaxial cable may be as small as 0.07 to 0.09 mm in diameter. The core conductor with its surrounding dielectric may be only on the order of 0.21 mm in diameter. These very fine conductors of very thin or small coaxial cables create considerable problems in designing connectors.

In particular, the conductor cores typically are terminated to a plurality of side-by-side terminals having very closely spaced contact portions typically in a parallel array along a slot of the connector. Problems continuously are encountered in aligning the very fine conductor cores with the closely spaced contact portions of the terminals. These problems are magnified when it is desirable to avoid completely stripping the coaxial cables down to the bare conductor core. This process, itself, is extremely tedious and time consuming. Therefore, it often is desirable to keep the dielectrics about the conductor cores. When this is done, insulation-displacement contacts or terminals must be used to pierce the insulation about the conductor cores. The present invention is directed to solving these problems whether the coaxial cables are discrete cables or a ribbon cable and whether the conductor cores are completely stripped or insulation displacement terminals are used.

SUMMARY OF THE INVENTION

An object, therefore, of the invention is to provide a new and improved connector assembly for connecting the conductors of a plurality of coaxial cables to associated electrical circuitry.

In the exemplary embodiment of the invention, the assembly includes a fixed connector having a dielectric housing mounted on a substrate on which the electrical circuitry is disposed. A plurality of terminals are mounted on the housing and are connected to the electrical circuitry. The terminals have contact arms in a side-by-side array at regularly spaced intervals. A movable connector is removably attached to the fixed connector and includes first and second assemblies. The first assembly has a plurality of rigid support members in a side-by-side array at regularly spaced intervals corresponding to the spacing of the contact arms of the fixed connector. The second assembly has a plurality of terminals in a side-by-side array at regularly spaced intervals corresponding to the spacing of the contact arms and the support members. The first and second assemblies are interengageable to sandwich the conductors of the cables between the support members of the first assembly and the terminals of the second assembly. Therefore, attaching the movable connector to the fixed connector is effective to connect the conductors of the cables to the electrical circuitry through the terminals of the first assembly of the movable connector and the contact arms of the fixed connector.

Generally, complementary interengaging pivot attachment means are provided between the fixed and movable connectors. Complementary interengaging latch means also are provided between the fixed and movable connectors. As disclosed herein, the first assembly of the movable connector overlies the second assembly and includes a shield over a substantial portion of the assemblies. The shield substantially covers the fixed connector. The pivot attachment means and the latch means are provided between the shield and the fixed connector.

According to one feature of the invention, the first assembly of the movable connector is movable relative to the second connector from a preliminary position whereat the conductors of the cables can be positioned between the support members of the first assembly and the terminals of the second assembly, to a terminating position clamping the conductors between the support members and the terminals. The terminals of the second assembly include insulation displacement means for piercing through insulation about the conductors. The second assembly also includes a housing for receiving portions of the support members of the first assembly when the first assembly is in the terminating position.

Another feature of the invention is a ground strip mounted on the fixed connector and connected to appropriate ground circuitry on the substrate. A pair of ground plates sandwich the coaxial cables therebetween in an area of shielded sections of the cables. One of the ground plates is engageable with the ground strip on the fixed connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
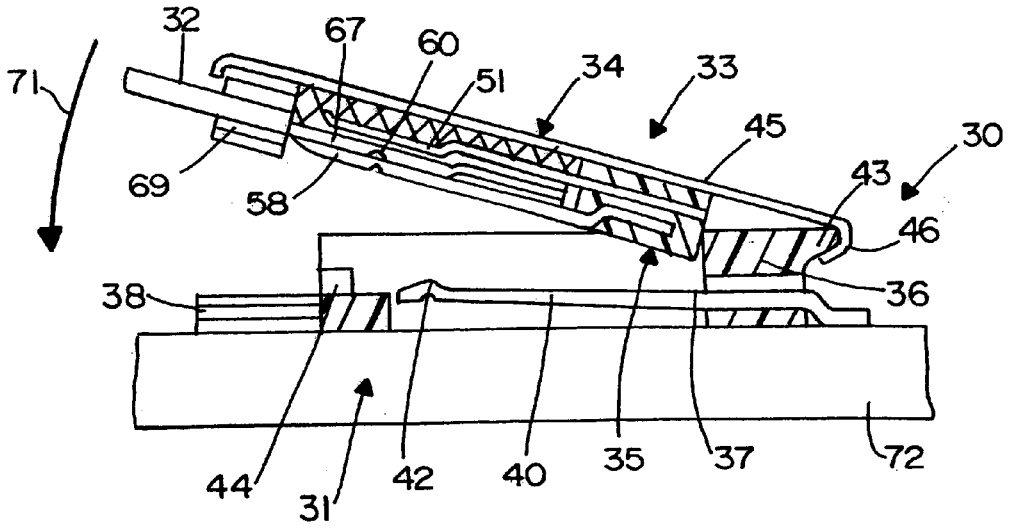
FIG. 1 is a front-to-rear section through the connector assembly of the invention, with the movable connector about to be attached to the fixed connector.
Figure 2:
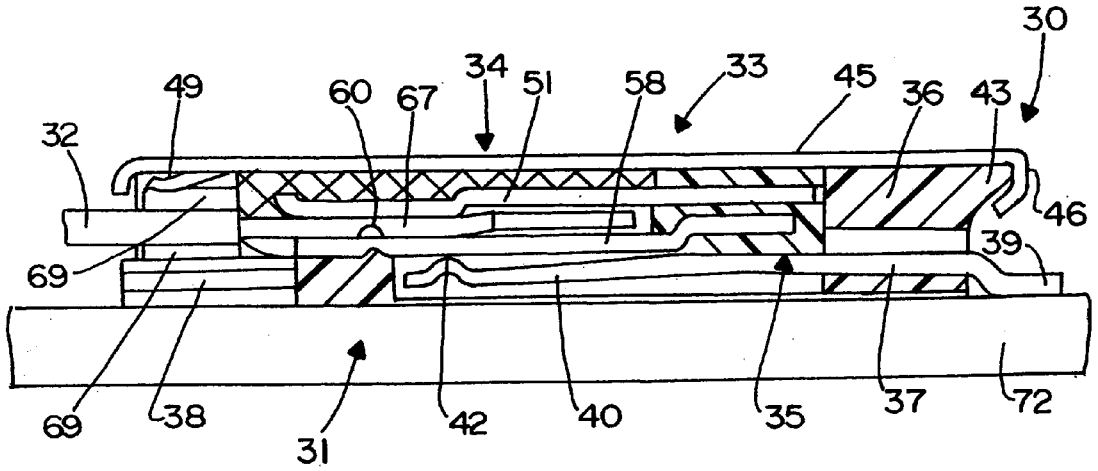
FIG. 2 is a view similar to that of FIG. 1, with the movable connector fully attached to the fixed connector.
Figure 3:
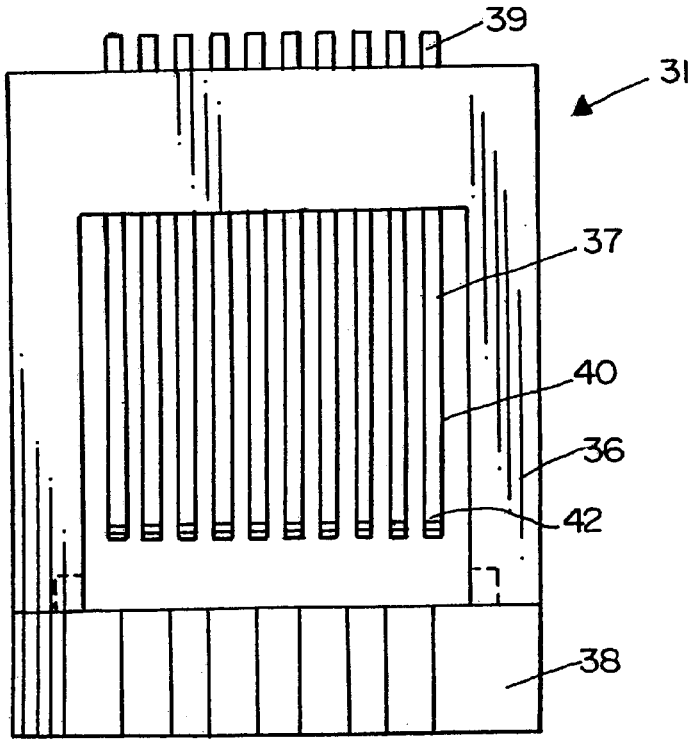
FIG. 3 is a top plan view of the fixed connector.

Referring to the drawings in greater detail, and first to FIGS. 1 and 2, the invention is embodied in a connector assembly, generally designated 30. The connector assembly includes a fixed connector, generally designated 31, and a movable connector, generally designated 33. The movable connector is removably attached to the fixed connector, as described hereinafter. Fixed connector 31 is mounted on a substrate 72, such as a printed circuit board, having electrical circuitry (not shown) thereon. Movable connector 33 terminates a plurality of coaxial cables 32. The movable connector includes a pair of relatively movable first and second assemblies, generally designated 34 and 35, respectively, as will be described in greater detail hereinafter. Fixed connector 31 is shown in FIGS. 3–6. First assembly 34 of movable connector 33 is shown in FIGS. 7–10. Second assembly 35 of the movable connector is shown in FIGS. 11–14.

Figure 4:
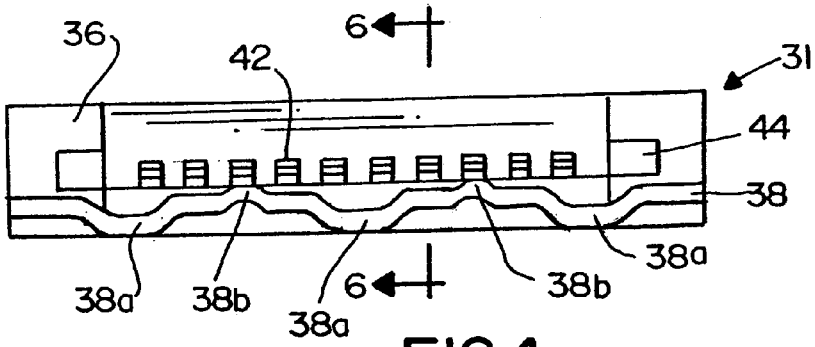
FIG. 4 is a front elevational view of the fixed connector.
Figure 5:
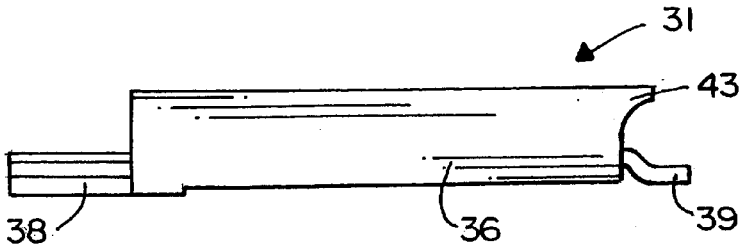
FIG. 5 is a side elevational view of the fixed connector.
Figure 6:
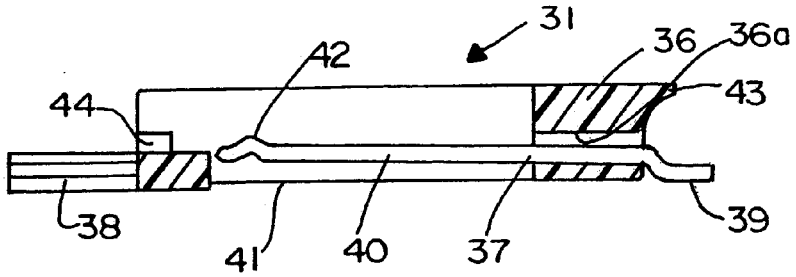
FIG. 6 is a vertical section taken generally along line 6—6 of FIG. 4.
Figure 7:
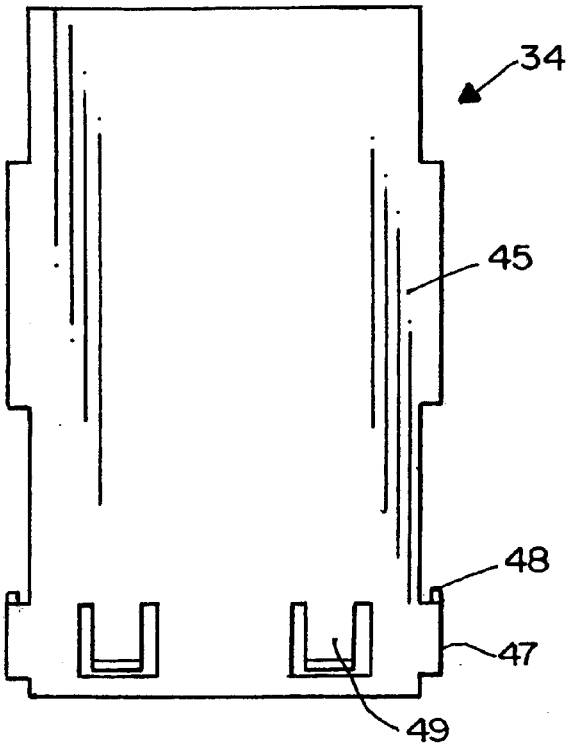
FIG. 7 is a top plan view of the first assembly of the movable connector.
Figure 8:
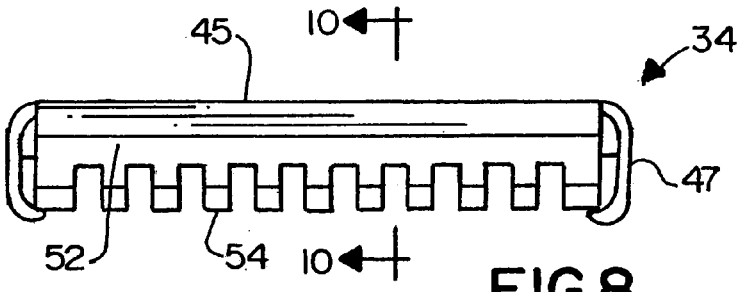
FIG. 8 is a front elevational view of the first assembly.
Figure 9:
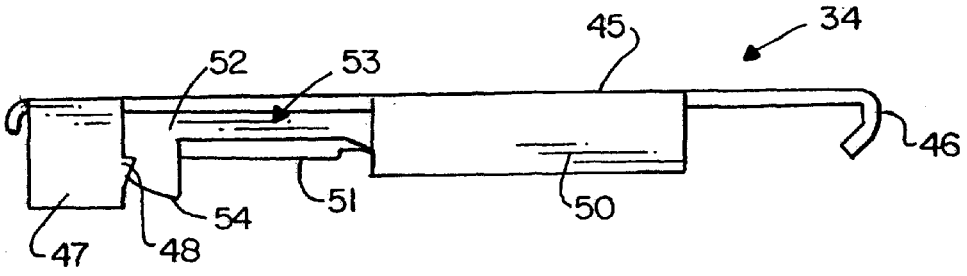
FIG. 9 is a side elevational view of the first assembly.

Referring to FIGS. 3–6, fixed connector 31 includes a dielectric housing 36 mounting a plurality of terminals 37. The housing is mounted on substrate 72 as shown in FIGS. 1 and 2. A ground terminal 38 is fixed to the front bottom edge of housing 36. As best seen in FIG. 4, the ground terminal is in the form of a wave-like strip having troughs 38*a* for engaging appropriate ground circuitry on substrate 72. The ground strip also has ridges or high points 38*b*. As best seen in FIG. 6, each terminal is mounted in a passage 36*a* in housing 36 and has a protruding tail portion 39 generally flush with a bottom surface 41 of the housing for connection to appropriate electrical circuitry or circuit traces on substrate 72. Each terminal includes a cantilevered contact arm 40 angled upwardly to a contact point 42. Terminals 37 and contact arms 40 are in a side-by-side array at regularly spaced intervals along housing 36. The top rear edge of housing 36 has a rearwardly projecting portion 43 which forms a fulcrum part of a pivot attachment means for movable connector 33, as will be described hereinafter. Latch recesses 44 are provided at the front of housing 36.

Figure 10:
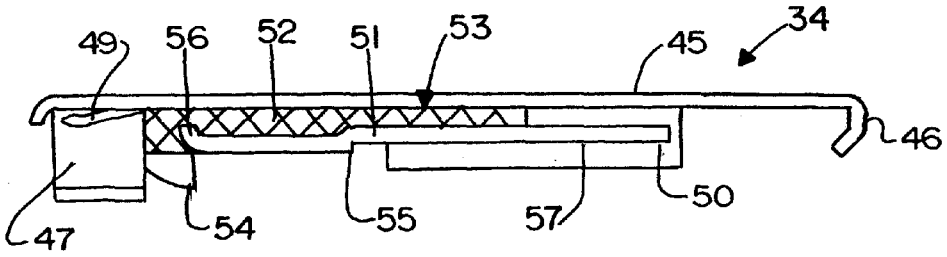
FIG. 10 is a vertical section taken generally along line 10—10 of FIG. 8.
Figure 11:
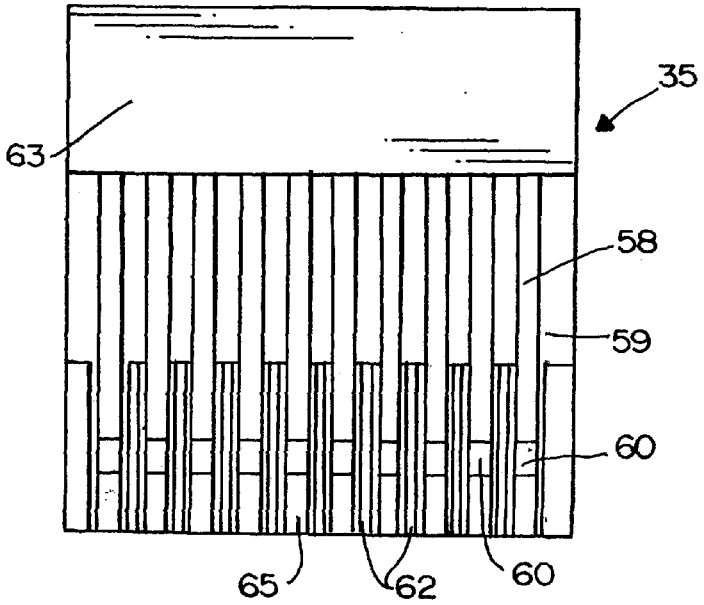
FIG. 11 is a top plan view of the second assembly of the movable connector.

FIGS. 7–10 show first assembly 34 of movable connector 33. In particular, first assembly 34 includes a top shield 45 which may be stamped and formed of sheet metal material. The shield includes a downwardly bent hook 46 at the rear edge thereof for engaging fulcrum projection 43 (FIGS. 5 and 6) of fixed connector 31. A pair of front L-shaped side latch flanges 47 engage within latch recesses 44 of housing 36 of the fixed connector. The latch flanges have rearwardly projecting teeth 48. A pair of resilient tabs 49 are stamped out of shield 45 and bent inwardly as best seen in FIG. 10. A pair of side walls 50 depend from shield 45.

Still referring to FIGS. 7–10, first assembly 34 of movable connector 33 includes a plurality of rigid support members 51 injection molded into a dielectric block 53 of plastic material or the like. The support members are elongated and are in a side-by-side array at regularly spaced intervals corresponding to the spacing of contact arms 40 (FIG. 6) of terminals 37 of fixed connector 31. Support members 51 are rod-like members and may be metal rods or be fabricated of non-metal materials. Each support rod 51 includes a contact section 52 exposed at the bottom of dielectric block 53 and a bent tip portion 56 embedded in overmolded dielectric block 53. A step 55 is formed in each support rod rearwardly of contact section 52. Dielectric block 53 has a plurality of teeth-like projections 54 (see FIG. 8) for guiding the conductor cores of coaxial cables 32 therebetween and into alignment with contact sections 52 of support rods 51. Finally, the support rods include rear ends 57 projecting rearwardly of dielectric block 53.

Figure 12:
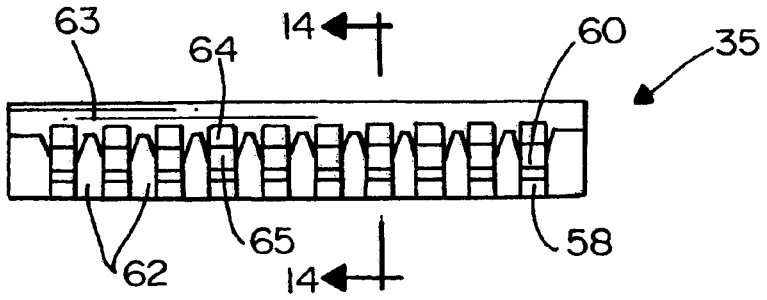
FIG. 12 is a front elevational view of the second assembly.
Figure 13:
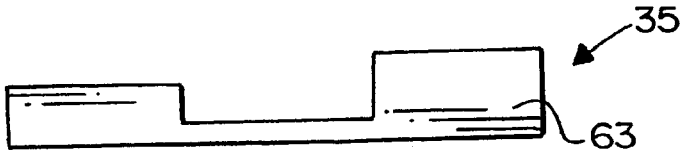
FIG. 13 is a side elevational view of the second assembly.
Figure 14:
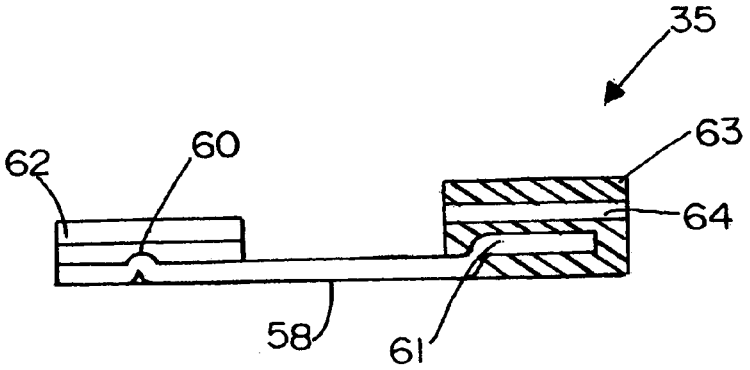
FIG. 14 is a vertical section taken generally along line 14—14 of FIG. 12.

Referring to FIGS. 11–14, second assembly 35 of movable connector 33 includes a plurality of terminals 58 in a side-by-side array at regularly spaced intervals corresponding to the spacing of contact arms 40 of fixed connector 31 and contact sections 52 of support rods 51 of first assembly 34 of the movable connector. Each terminal 58 includes an insulation displacement projection 60 disposed between a pair of guide flanges 62 and an offset end 61 injection molded in a dielectric block 63 having through holes 64 therein. The through holes are aligned with terminals 58 as seen in FIG. 12. Side flanges 62 of terminals 58 define slots 65 therebetween, the slots being above terminals 58 and below through holes 64 in dielectric block 63.

Figure 15:
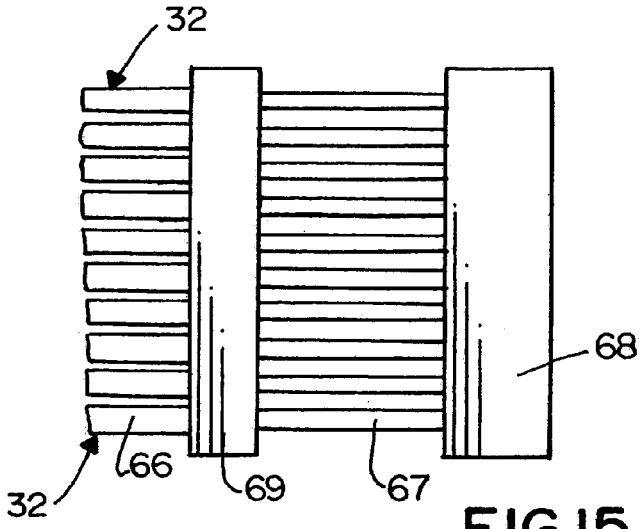
FIG. 15 is a top plan view of a plurality of coaxial cables being prepared for termination in the movable connector.

FIG. 15 shows how coaxial cables 32 are prepared for termination by connector assembly 30. In particular, each coaxial cable 32 includes an outer covering or sheath 66 which is stripped back to expose shielded sections (not visible in the drawing) which are clamped between a pair of ground plates 69. Insulated conductor cores 67 extend beyond ground plates 69 and are held by a fixture 68 which precisely spaces the insulated conductors at regularly spaced intervals corresponding to the spacing of support rods 51 of first assembly 34 and terminals 58 of second assembly 35 which, in turn, are spaced corresponding to the spacing of terminals 40 of fixed connector 31.

Figure 16:
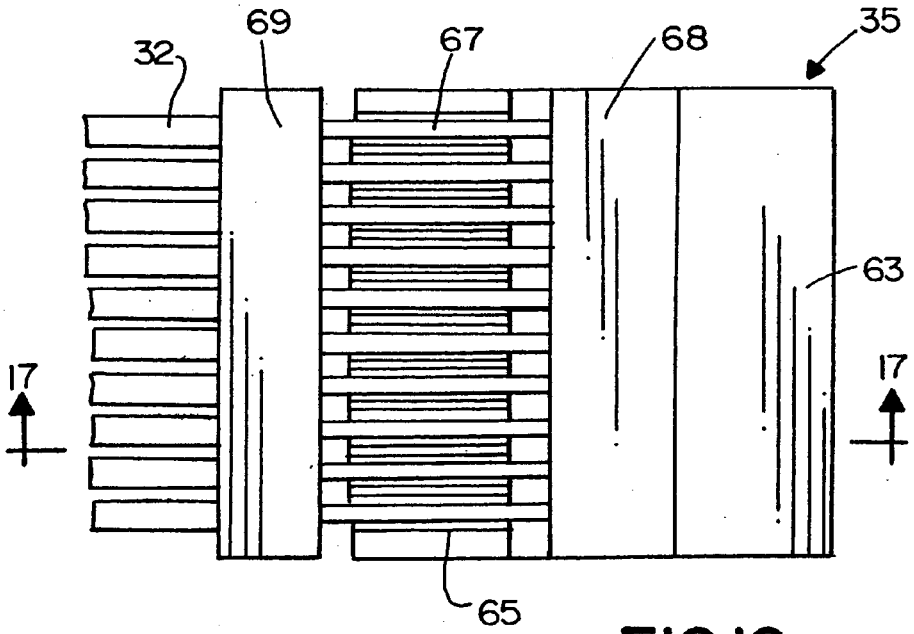
FIG. 16 is a top plan view showing the subassembly of FIG. 15 mounted in the second assembly of the movable connector.
Figure 17:
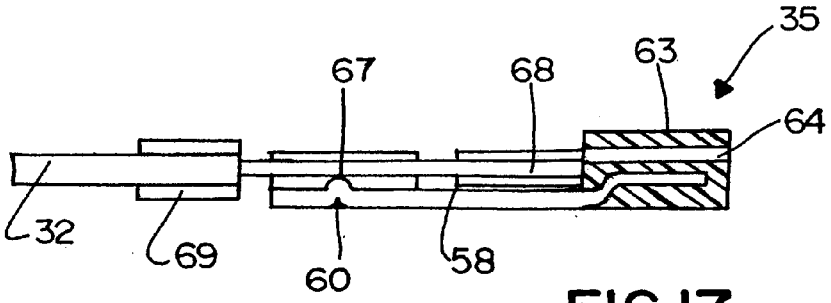
FIG. 17 is a vertical section taken generally along line 17—17 of FIG. 16.
Figure 18:
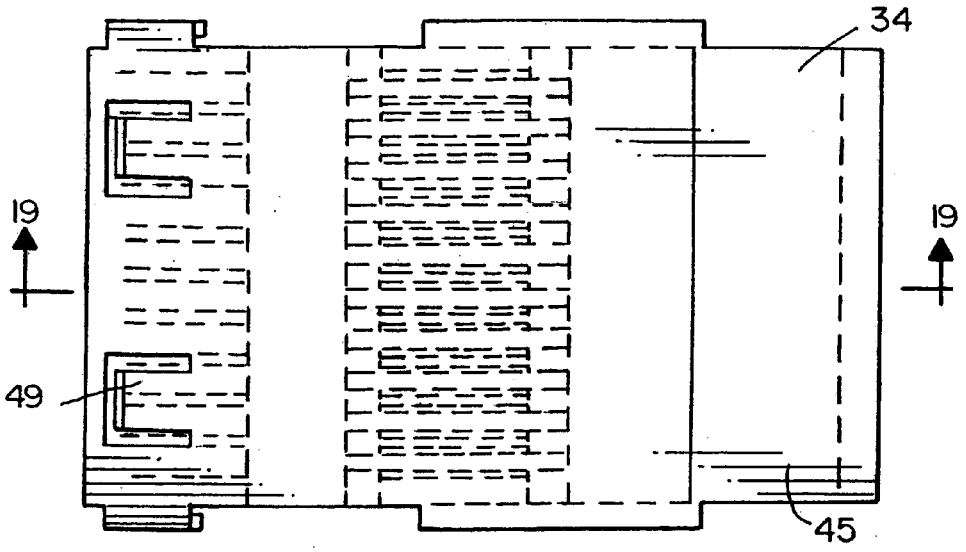
FIG. 18 is a top plan view of the second assembly of the movable connector similar to FIG. 7, but showing in dotted lines the underlying proximity of the interior components.
Figure 19:
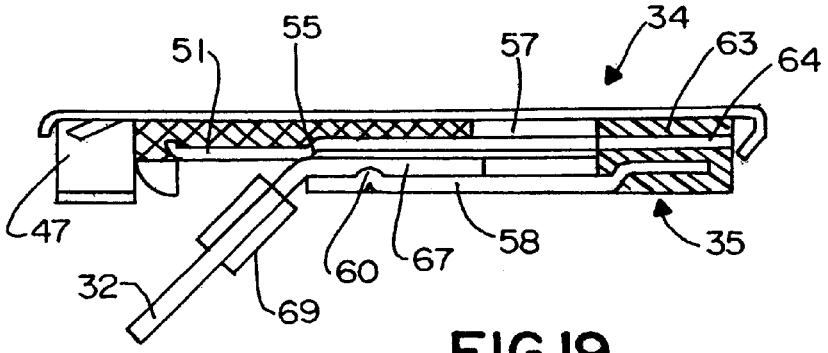
FIG. 19 is a vertical section taken generally along line 19—19 in FIG. 18.
Figure 20:
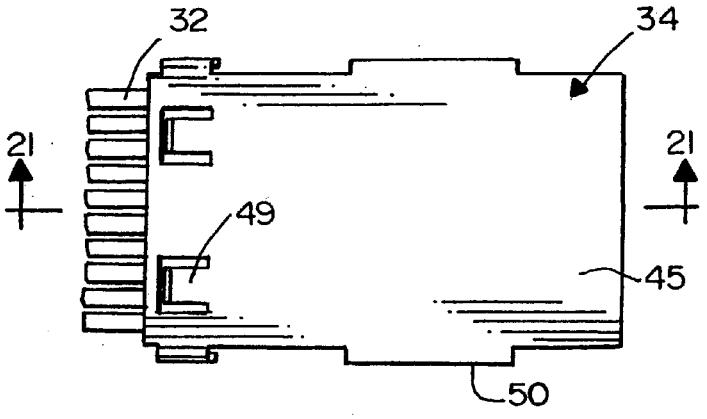
FIG. 20 is a top plan view of the movable connector assembly with the coaxial cables fully terminated.

Referring to FIGS. 16 and 17, the subassembly of FIG. 15 then is nested into second assembly 35, with fixture 68 abutting against dielectric block 63 and with insulated conductors 67 positioned in slots 65. It can be seen that ground plates 69 are exposed forwardly of second assembly 35. Fixture 68 then is removed, and first assembly 34 is positioned on top of second assembly 35 as seen in FIGS. 18 and 19. It should be noted particularly in FIG. 19 that ends 57 of support rods 51 of first assembly 34 are outside through holes 64 in dielectric 63 of second assembly 35.

Figure 21:
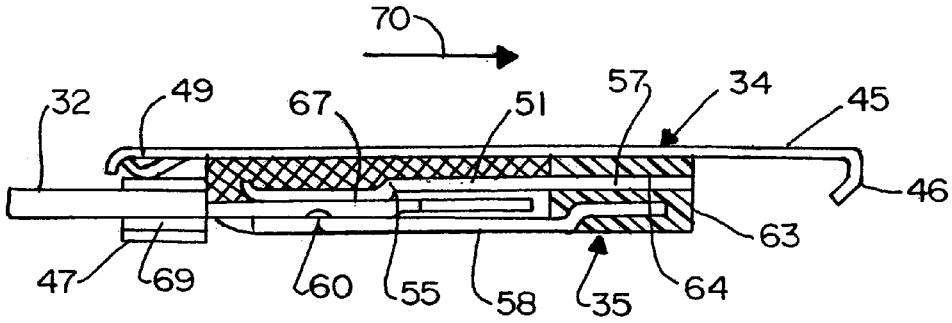
FIG. 21 is a vertical section taken generally along line 21—21 of FIG. 20.

First assembly 34 then is moved relative to second assembly 35 in the direction of arrow 70 in FIG. 21. This causes ends 57 of support rods 51 of the first assembly to move into through holes 64 of dielectric block 63 of the second assembly. This movement also causes steps 55 and contact sections 52 of support rods 51 to drive insulated conductors 67 into insulation displacement projections 60 of terminals 58. Movable connector 33 now is fully assembled as seen in FIG. 21. The movable connector then is positioned as seen in FIG. 1, with rear hook 46 of shield 45 engaging fulcrum projection 43 of housing 36 of fixed connector 31. The movable connector then is moved downwardly in the direction of arrow 71 until latch flanges 47 (FIGS. 9 and 10) engage latch recesses 44 (FIG. 1) to latch the movable connector to the fixed connector. In the latched condition, the lower ground plate 69 which sandwiches the shielded sections of coaxial cables 32 comes into engagement with ridges 38*b* (FIG. 4) of ground strip 38 of fixed connector 31. Resilient tabs 49 of shield 45 engage the top ground plate 69. With ground strip 38 connected, as by soldering, to ground circuitry on substrate 72, the entire shielding/grounding system of connector assembly 30 is commoned, including shield 45, ground plates 69, the shielded sections of coaxial cables 32, ground strip 38 and the ground circuitry on substrate 72.

Figure 22:
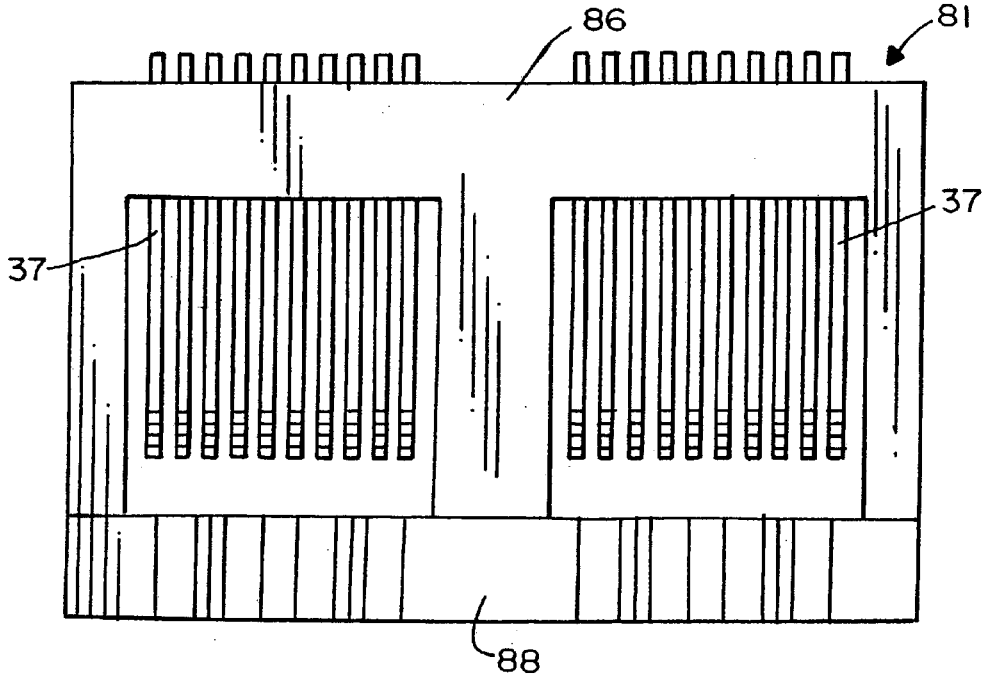
FIG. 22 is a top plan view of an alternate form of fixed connector for receiving a pair of movable connectors.
Figure 23:
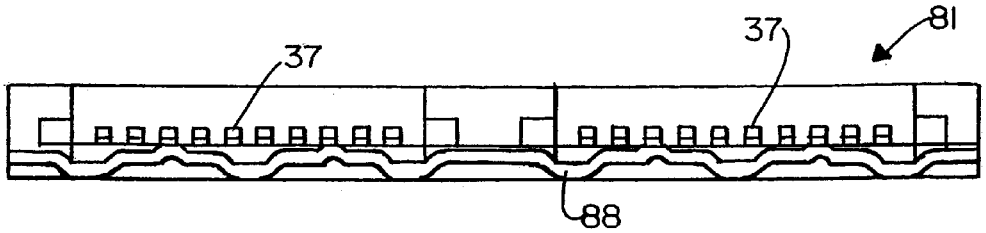
FIG. 23 is a front elevational view of the fixed connector of FIG. 22.

Finally, FIGS. 22 and 23 simply show an alternative version of a fixed connector, generally designated 81, which includes a common housing 86 mounting two groups of terminals 37. A single ground strip 88 extends across the front of housing 86. With this embodiment, two movable connectors 34 can be removably attached to the single housing in a side-by-side arrangement. Of course, it is contemplated that more than two terminal arrays 37 can be provided for accommodating any number of movable connectors 33.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A connector assembly for connecting conductors of a plurality of coaxial cables to associated electrical circuitry, comprising:

a fixed connector including a dielectric housing mounted on a substrate on which the electrical circuitry is disposed, and a plurality of terminals mounted on the housing and connected to the electrical circuitry, the terminals having contact arms in a side-by-side array at regularly spaced intervals; and a movable connector removably attached to the fixed connector and including first and second assemblies, said first assembly having a plurality of rigid support members in a side-by-side array at regularly spaced intervals corresponding to the spacing of said contact arms of the fixed connector, said second assembly having a plurality of terminals in a side-by-side array at regularly spaced intervals corresponding to the spacing of the contact arms and said support members, said first and second assemblies being interengageable to sandwich the conductors of the cables between the support members of the first assembly and the terminals of the second assembly, and whereby attaching the movable connector to the fixed connector is effective to connect the conductors of the cables to the electrical circuitry through the terminals of the second assembly of the movable connector and the contact arms of the fixed connector.

2. The connector assembly of claim 1 wherein said fixed connector includes a ground strip connected to appropriate ground circuitry on the substrate, and including a pair of ground plates sandwiching the coaxial cables therebetween in an area of shielded sections of the cables, one of the ground plates being engageable with said ground strip.

3. The connector assembly of claim 1 wherein the contact arms of the terminals of the fixed connector are cantilevered spring arms.

4. The connector assembly of claim 1, including complementary interengaging pivot attachment means between the fixed and movable connectors.

5. The connector assembly of claim 4, including complementary interengaging latch means between the fixed and movable connectors.

6. The connector assembly of claim 1 wherein said first assembly overlies the second assembly and includes a shield over a substantial portion of the assemblies.

7. The connector assembly of claim 6 wherein said shield substantially covers the fixed connector.

8. The connector assembly of claim 6, including complementary interengaging pivot attachment means between the shield and the fixed connector.

9. The connector assembly of claim 6, including complementary interengaging latch means between the shield and the fixed connector.

10. The connector assembly of claim 1 wherein said first assembly is movably mounted on the second assembly.

11. The connector assembly of claim 10 wherein said first assembly is movable relative to the second assembly from a preliminary position whereat the conductors of the cables can be positioned between the support members of the first assembly and the terminals of the second assembly, to a terminating position clamping the conductors between the support members and the terminals.

12. The connector assembly of claim 11 wherein said terminals of the second assembly include insulation displacement means for piercing through insulation about the conductors.

13. The connector assembly of claim 11 wherein said second assembly includes a housing for receiving portions of the support members of the first assembly when the first assembly is in said terminating position.

14. The connector assembly of claim 1 wherein the first assembly of said movable connector includes a dielectric block overmolded about portions of the support members.

15. The connector assembly of claim 1 wherein said terminals of the second assembly include insulation displacement means for piercing through insulation about the conductors.

16. A connector assembly for connecting conductors of a plurality of coaxial cables to associated electrical circuitry, comprising:

a fixed connector including a dielectric housing mounted on a substrate on which the electrical circuitry is disposed, and a plurality of terminals mounted on the housing and connected to the electrical circuitry, the terminals having contact arms in a side-by-side array at regularly spaced intervals; and a movable connector removably attached to the fixed connector and including a first assembly movably mounted on a second assembly, said first assembly having a dielectric block mounting a plurality of rigid support members in a side-by-side array at regularly spaced intervals corresponding to the spacing of said contact arms of the fixed connector and with the first assembly overlying the second assembly and including a shield over a substantial portion of the assemblies and substantially covering the fixed connector, said second assembly having a plurality of terminals in a side-by-side array at regularly spaced intervals corresponding to the spacing of the contact arms and said support members, said first and second assemblies being interengageable to sandwich the conductors of the cables between the support members of the first assembly and the terminals of the second assembly, complementary interengaging pivot attachment means between the shield of the first assembly of the movable connector and the fixed connector, and whereby attaching the movable connector to the fixed connector is effective to connect the conductors of the cables to the electrical circuitry through the terminals of the second assembly of the movable connector and the contact arms of the fixed connector.

17. The connector assembly of claim 16, including complementary interengaging latch means between the shield of the first assembly of the movable connector and the fixed connector.

18. The connector assembly of claim 16 wherein said fixed connector includes a ground strip connected to appropriate ground circuitry on the substrate, and including a pair of ground plates sandwiching the coaxial cables therebetween in an area of shielded sections of the cables, one of the ground plates being engageable with said ground strip.

19. The connector assembly of claim 16 wherein the contact arms of the terminals of the fixed connector are cantilevered spring arms.

20. The connector assembly of claim 16 wherein said first assembly is movable relative to the second assembly from a preliminary position whereat the conductors of the cables can be positioned between the support members of the first assembly and the terminals of the second assembly, to a terminating position clamping the conductors between the support members and the terminals.

21. The connector assembly of claim 20 wherein said terminals of the second assembly include insulation displacement means for piercing through insulation about the conductors.

22. The connector assembly of claim 20 wherein said second assembly includes a housing for receiving portions of the support members of the first assembly when the first assembly is in said terminating position.

* * * * *